United States Patent [19]

Irving et al.

[11] Patent Number: 4,916,052

[45] Date of Patent: Apr. 10, 1990

[54] HOLLOW SILVER HALIDE GRAINS AND PROCESS FOR THE PREPARATION THEREOF

[75] Inventors: Mark E. Irving; Robert J. Newmiller, both of Rochester, N.Y.

[73] Assignee: Eastman Kodak Company, Rochester, N.Y.

[21] Appl. No.: 369,795

[22] Filed: Jun. 22, 1989

[51] Int. Cl.[4] ..... G03C 1/02

[52] U.S. Cl. ..... 430/567; 430/569

[58] Field of Search ..... 430/567, 569

[56] References Cited

U.S. PATENT DOCUMENTS 4,419,442 12/1983 Falxa et al. ..... 430/567

4,710,455 12/1987 Iguchi et al. ..... 430/567

*Primary Examiner*—Paul R. Michl

*Assistant Examiner*—T. Neville

*Attorney, Agent, or Firm*—Thomas F. Kirchoff

[57] ABSTRACT

Hollow silver halide grains and a process for their preparation are described. The hollow grains have high surface area/volume ratio and enhanced light absorption.

26 Claims, 5 Drawing Sheets

HOLLOW SILVER HALIDE GRAINS AND PROCESS FOR THE PREPARATION THEREOF

The present invention relates to hollow silver halide grains and to a process for the preparation thereof. The silver halide grains of this invention have high surface area/volume ratios and enhanced light absorption. More particularly, this invention relates to a process for the preparation of silver bromoiodide grains having hollow grain structures.

The primary morphological forms for silver bromide and silver bromoiodide are varied and are well known in the literature. Such grains range from those having semi- (110) faces and consisting substantially of silver bromide and siliver iodobromide such as described in U.S. Pat. No. 4,775,615, to grains of tetradecahedral configuration having external faces with Miller indices (110) and (111) as are described in U.S. Pat. No. 4,720,452; to octahedral or tetradecahedral silver iodobromide crystals comprising at least 4 mol % silver iodide as prepared by the process of U.S. Pat. No. 4,610,958; to substantially monodispersed core/shell type grains which are sensitized with a combination of dyes as described in U.S. Pat. No. 4,704,351; to tabular silver bromoiodide grains having thicknesses less than 0.3 μm, diameters of at least 0.6 μm and at least 50% of the total projected area as silver bromoiodide grains as disclosed in U.S. Pat. No. 4,433,048.

U.S. Pat. No. 4,150,994 describes preparation of silver iodobromide or of silver iodochloride emulsions, utilizing an Ostwald ripening step, which produces silver halide grains of the twinned octahedral or cubic type. This patent describes silver halide seed grains. Emulsions made from such grains are described as having improved homogeneity of iodide content and controlled size distribution of crystal formation. Higher covering power and contrast after development are stated to be improvements obtained with these emulsions. However, this patent neither teaches nor suggests a process for the preparation of hollow silver halide grains.

U.S. Pat. Nos. 4,184,877 and 4,184,878 are similar to the '994 patent noted above and describe preparation, without use of an Ostwald ripening step, of twinned silver halide crystals formed from silver iodide grains which are predominantly of the hexagonal type. The '878 patent follows the procedure of the '994 patent but also includes the step of chemically sensitizing the silver halide grains.

U.S. Pat. No. 4,414,310 is directed to a process for preparing tabular grain silver bromoiodide emulsions wherein silver and bromide salts are concurrently introduced into a reaction vessel containing an emulsion comprising a dispersing medium and high iodide silver halide grains. Prior to concurrent introduction of silver and bromide salts the mean diameter of the high iodide silver halide grains is limited to less than 0.1 micron and the concentration of iodide is limited to less than $10^{-2}$ mole per liter.

None of the above patents or publications describes or suggests hollow silver halide grains or their preparation.

Generally, the process of this invention comprises forming predominantly silver iodide grains having the morphological configuration of four hexagonal bipyramids, the four bases of which are joined to form a common tetrahedron and initiating epitaxial growth thereon along the ends of one or more of the bipyramidal legs of controlled precipitation and continuing such precipitation until the edges of the epitaxial crystals grow through various stages and ultimately grow together to complete the formation of hollow grains.

Silver halide seed grains comprising at least 90 mole % iodide and a process for their preparation is disclosed in co-filed U.S. application Ser. No. 369,798 of Mark E. Irving, entitled "SILVER HALIDE GRAINS AND PROCESS FOR THEIR PREPARATION".

The present invention provides a process for the preparation of hollow, radiation sensitive silver halide grains which process comprises the steps of:

(a) forming in a colloid dispersing medium silver halide grains containing at least 90 mol % iodide and having predominantly crystals of the configuration of four truncated hexagonal bipyramids, the four bases of which are joined to form a common tetrahedron by homogeneous nucleation of silver iodide grains at a pAg of from about 11.0 to about 5.0 at a temperature between about 30° and about 90° C.;

(b) maintaining these conditions in step (a) until the silver iodide grains are from about 0.005 to about 0.5 μm in diameter;

(c) altering the growth environment of the silver iodide grains to a pAg of from about 13.5 to about 9.8 at a temperature from about 30° to about 90° C.; and (d) nucleating iodohalide epitaxy on the end faces of each of the four hexagonal bipyramids of the silver iodide grains at a pAg of from about 3.0 to about 11.0 and a temperature between about 30° and 90° C.

If desired, the process of steps (a) to (d) may be continued with one or more of the following steps:

(e) continuing grain growth of the silver halide to the point at which the edges of the adjacent epitaxial crystals meet;

(e) continuing grain growth to close the corners between the major faces of the four hexagonal bipyramids; and (g) precipitating additional silver halide on the external surfaces of the hollow grains.

The process through which hollow grains are formed consists of the following morphological description:

(a) through (c) Precipitate silver iodide seeds which have the morphological configuration of four hexagonal bipyramids extending from a central region at the tetrahedral angle as is illustrated in FIG. I. The end face of each of the four truncated hexagonal bipyramids is a <0001> crystal face of silver iodide.

(d) As silver and halide is added to the kettle, an epitaxial deposit occurs on the above-noted <0001> faces of silver iodide. The morphology of the epitaxial deposit is a function of the halides being precipitated and the enrivonment under which they are grown.

In the case where silver bromide is precipitated, octahedral crystals can be initiated as the epitaxial habit. In a preferred form, the octahedral habit is of the twinned type, resulting in tabular epitaxial grain growth as in U.S. Pat. Nos. 4,104,877 and 4,414,310. In the case where silver chloride is precipitated, cubic crystals can be initiated as the epitaxial habit as in U.S. Pat. No. 4,094,684. Under certain conditions such as described in U.S. Pat. No. 4,399,215, the predominantly silver chloride epitaxial crystals can be deposited as tabular grains. Of course, combinations of bromide and chloride could be employed during this process.

It is thermodynamically anticipated that some of the iodide in the seed crystals will be incorporated into the epitaxial deposits in the amount of between about 0 to 40 mole % iodide. It can therefore be appreciated that soluble iodide can be added as a reactant in addition to the soluble bromide and/or chloride. In all cases, the <111> face of the iodohalide epitaxy is parallel to the <0001> face of the silver iodide seed crystal. Thus, the growing crystal consists of four epitaxial crystals joined to the end of each of the four silver iodide legs. FIGS. 2*a* and 2*b* illustrate the case where the epitaxial habit is tabular.

The epitaxial portion of the crystals continue to grow as silver and halide ions are added to the precipitation. As the growth is continued the point is reached at which the edges of the adjacent epitaxial crystals meet. This is illustrated for the tabular case in FIG. 3.

After the edges meet, the corners of the hollow body are filled in. This is illustrated in FIG. 4 and completes formation of the hollow structure. Any silver halide precipitated after this point is deposited on the external hollow grain surface.

Once growth is continued to the point where the edges of the adjacent epitaxial crystals meet (FIG. 3), if desired, growth of the hollow silver halide grains can be continued or growth can be terminated. In the latter case it is possible to obtain grains which are suitable for use as is, or which can be preserved as intermediates for subsequent growth of hollow grains.

In the preferred case where the epitaxial grain growths are tabular, the external structure of the hollow grain consists of four major surfaces of <111> faces which lie on a common tetrahedron. These faces are hexagonal in shape and are the four epitaxial tabular grain growths mentioned earlier. There are also four minor surfaces, triangular in shape, which lie on the corresponding negative tetrahedron. These surfaces are also believed to consist of <111> faces. The composite external structure is therefore composed of both positive and negative tetrahedrons, whose faces are present in unequal amounts.

In instances where the hollow silver halide grains are not completely formed, the four minor triangular surfaces of the grains may be unformed or only partially or incompletely formed. Also, where grain formation is not complete, the four major hexagonally shaped surfaces may be incomplete so as not to be completely grown together. Similar descriptions exist in the cases where the epitaxial deposits are non-tabular.

Evidence that the grains are hollow comes from three sources:

(a) Scanning electron micrographs taken under high vacuum show a portion of the grains which have apparently exploded from the pressure difference. A hollow center can be seen in the images of such grains.

(b) Optical micrographs of these grains show an internal line of diffraction contrast. This would be the result of the difference in index of refraction between the silver halide shell around the presumably gelatin and water core. Of course, one of the advantages of such a hollow grain would be that many compounds could be included in the center of each grain.

(c) Continuous growth of the grains, as evidenced by the attached figures, shows formation of hollow structures under the conditions of grain formation.

In a brief description of the drawings, for the particular case where the epitaxial crystals are tabular:

FIG. 1 is a photomicrograph which illustrates silver iodide grains in the configuration of four truncated bipyramids, the four bases of which are joined to form a common tetrahedron, including grains on which epitaxial growth can be seen on the ends of the bipyramidal legs.

FIGS. 2*a* and 2*b* are photomicrographs which illustrate continued epitaxial grain growth on the ends of the bipyramidal legs.

Figure 1:
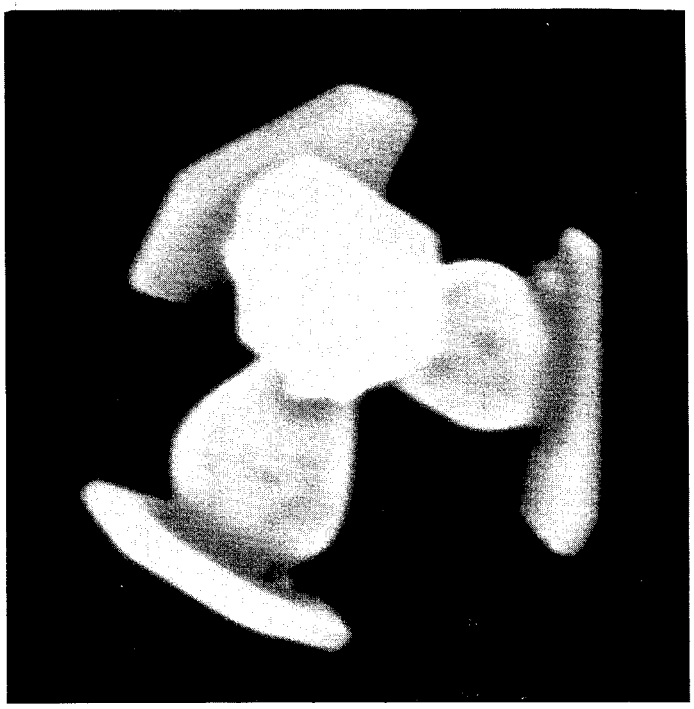
Figure 2A:
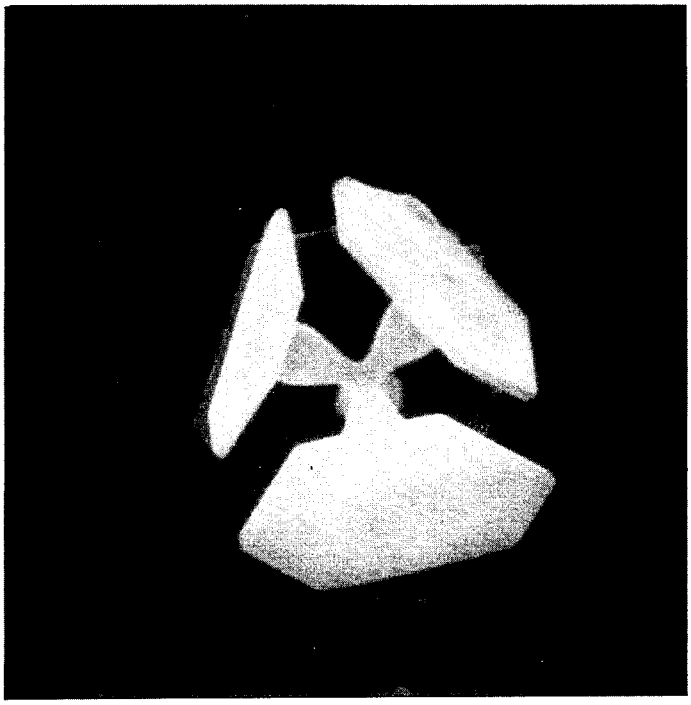
Figure 2B:
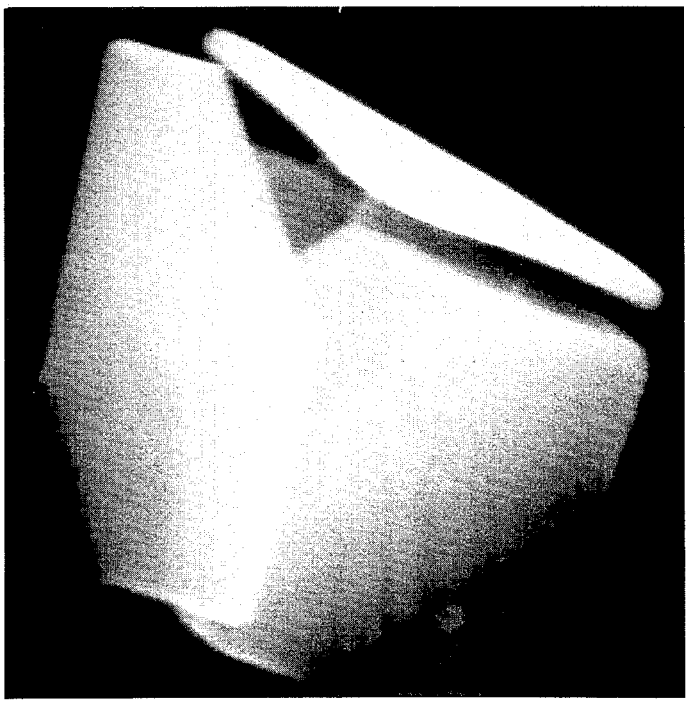
Figure 3:
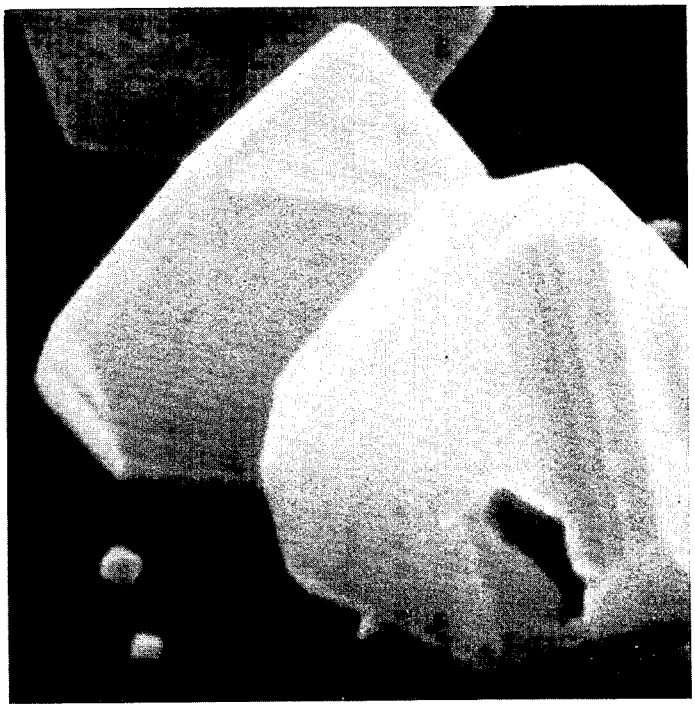
FIG. 3 is a photomicrograph which illustrates essentially completed epitaxial growth closing the corners of a crystal to complete hollow grain formation.
Figure 4:
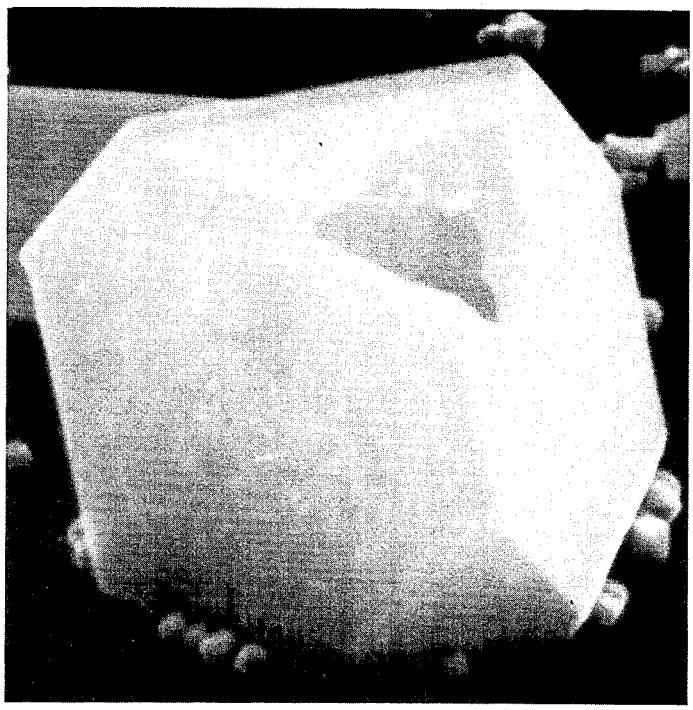
FIG. 4 illustrates hollow silver halide grains produced by the process of this invention. One grain shell has been broken as a result of the vacuum environment within a scanning electron microscope.

One method of increasing the size of the silver halide crystals formed in the process described herein is to carry out the precipitation in the presence of a silver halide solvent. It is preferred that grain growth, or ripening, occur within the reaction vessel during grain formation. Known ripening agents can be used. These include ammonia or an excess of halide ions. It is therefore apparent that the halide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions.

Among other ripening agents are those containing sulfur. Thiocyanate salts can be used, such as alkali metal, e.g. sodium and potassium, and also ammonium thiocyanate. While any conventional quantity of the thiocyanate salts can be introduced, preferred concentrations are generally from about 0.1 to 20 grams of thiocyanate salt per mole of silver halide. Illustrative piror teachings of employing thiocyanate ripening agents are found in U.S. Pat. Nos. 2,222,264; 2,448,534; 3,320,069; the disclosures of which are herein incorporated by reference. Alternatively, thioether ripening agents, such as those disclosed in U.S. Pat. Nos. 3,271,157; 4,574,628; 3,737,313; and 4,749,646, herein incorporated by reference, can be employed. Also, the solubility of the silver bromide may conveniently be controlled by variation of temperature, by the quantity of excess bromide ion and by the proportion of silver halide solvent in the dispersing medium.

Typical silver halide solvents which are suitable for use in the process of the present invention include ammonia, thiocyanates, thiosulfates and various thioether and thiourea compounds. Thioether solvents include those described in U.S. Pat. Nos. 3,271,157; 3,531,289; 3,574,628; 3,767,413; 4,311,638 and 4,725,560. Useful thiourea solvents include those described in U.S. Pat. Nos. 4,284,717; 4,568,635; 4,695,534; 4,635,535; 4,713,322 and 4,749,646.

The silver halide grains produced in accordance with the process of this invention will have a bulk percent iodide content of about 2 to about 80%. The size range of the grains, as determined by the equivalent circular diameter of their projected area, is from about 0.1 μm to about 20 μm.

Various modifying compounds such as silver halide solvents, ripening agents, spectral or sensitizing dyes or dopants, and the like, may be present during grain precipitation. Depending upon the nature of some of these compounds they can be absorbed to the interior of the hollow grain surfaces. This is particularly true of sensitizing dyes.

In addition, photographically useful agents, such as developing agents, development, accelerators, development inhibitors, image dye-forming couplers and the like, or precursors of such photographically useful agents, can be present during grain precipitation to be incorporated within the hollow grain structure. Such agents will then become available at various stages in the development of the hollow grains, depending upon the environment in which they are present.

The modifying compounds and photographically useful agents can be initially in the reaction vessel or can be added either separately or along with one or more of the salts according to conventional procedures.

Chemical sensitizers and dopants, such as compounds of copper, thallium, lead, bismuth, cadmium, zinc, middle chalcogens (i.e., sulfur, selenium and tellurium), gold and Group VIII noble metals, can be present during silver halide precipitation. This is illustrated by U.S. Pat. Nos. 1,195,432; 1,951,933; 2,448,060; 2,628,167; 2,950,972; 3,488,709; 3,737,313; 3,772,031 and 4,269,927 and *Research Disclosure,* Vol. 134, June 1975, Item 13452. *Research Disclosure* and its predecessor, *Product Licensing Index,* are publications of Kenneth Mason Publications Limited; Emsworth, Hampshire P010 7DD; United Kingdom. The emulsions can be internally reduction sensitized during precipitation, as illustrated by Moisar et al, Journal of Photographic Science, Vol. 25, 1977, pp. 19–27.

The individual silver and halide salts can be added to the reaction vessel through surface or subsurface delivery tubes, by gravity feed or by delivery apparatus for maintaining control of the rate of delivery and the pH, pBr, and/or pAg of the reaction vessel contents. This is illustrated by U.S. Pat. Nos. 3,821,002 and 3,031,304 and in Claes et al, *Photographische Korresondenz,* Band 102, Number 10, 1967, p. 162. In order to obtain rapid distribution of the reactants within the reaction vessel, specially constructed mixing devices can be employed. These are illustrated by U.S. Pat. Nos. 2,996,287; 3,342,605; 3,415,650; 3,785,777; 4,147,551 and 4,171,224; U.K. patent application No. 2,022,431A; German OLS Nos. 2,555,364 and 2,556,885, and *Research Disclosure,* Volume 166, February 1978, Item 16662.

In forming emulsions a dispersing medium is initially contained in the reaction vessel. In a preferred form the dispersing medium is comprised of an aqueous peptizer suspension. Peptizer concentrations of from 0.2 to about 10 percent by weight, based on the total weight of emulsion components in the reaction vessel, can be employed. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additional vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g. cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agaragar, arrowroot, albumin and the like as described in U.S. Pat. Nos. 2,614,928; 2,614,929; 2,691,582; 2,614,930; 2,614,931; 2,327,808; 2,448,534; 2,787,545; 2,956,880; 3,061,436; 2,816,027; 3,132,945; 3,138,461; 3,186,846; 2,960,405; 3,436,220; 3,486,896; 2,992,213; 3,157,506; 3,184,312; 3,539,353; 3,227,571; 3,532,502; 3,551,151 and 4,018,609.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams) acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine, acrylates, vinyl imidazole copolymers, vinyl sulfide copolymers, halogenated styrene polymers, amineacrylamide polymers, polypeptides and the like as described in U.S. Pat. Nos. 3,679,425; 3,706,564; 3,813,251; 2,253,078; 2,276,322; 2,276,323; 2,281,703; 2,311,058; 2,414,207; 2,484,456; 2,541,474; 2,632,704; 3,425,836; 3,415,653; 3,615,624; 3,488,708; 3,392,025; 3,511,818; 3,681,079; 3,721,565; 3,852,073; 3,861,918; 3,925,083; 3,879,205; 3,142,568; 3,062,674 and 3,220,844.

These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the photographic elements of this invention, but also in other layers, such as overcoat layers, interlayers and layers positioned beneath the emulsion layers.

The emulsions are preferably washed to remove soluble salts. The soluble salts can be removed by decantation, filtration, and/or chill setting and leaching, as illustrated by U.S. Pat. Nos. 2,316,845 and 3,396,027, by coagulation washing, as illustrated by U.S. Pat. Nos. 2,618,556; 2,614,928; 2,565,418; 3,241,969 and 2,489,341, by centrifugation and decantation of a coagulated emulsion, as illustrated by U.S. Pat. Nos. 2,463,794; 3,707,378; 2,996,287 and 3,498,454, by employing hydrocyclones alone or in combination with centrifuges, as illustrated by U.K. Pat. Nos. 1,336,692; 1,356,573 and by Ushomirskii et al Soviet Chemical Industry, Vol. 6, No. 3, 1974, pp. 181–185. The emulsions, with or without sensitizers, can be dried and stored prior to use as illustrated by *Research Disclosure,* Vol. 101, September 1972, Item 10152. Washing is particularly advantageous after the completion of precipitation.

The high surface area grain silver halide emulsions of the present invention are chemically sensitized. These and other silver halide emulsions herein disclosed can be chemically sensitized with active gelatin, as illustrated by T. H. James, The Theory of the Photographic Process, 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April 1974, Item 12008, *Research Disclosure,* Vol, 134, June 1975, Item 13452, Sheppard et al. U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocycli nuclei. Exemplary finish modifiers are described in Brooker et al U.S. Pat. No. 2,131,038, Dostes U.S. Pat. No. 3,411,914, Kuwahara et al U.S. Pat. No. 3,554,757, Oguchi et al U.S. Pat. No. 3,565,631, Oftedahl U.S. Pat. No. 3,901,714, Walworth Canadian Patent No. 778,723, and Duffin Photographic Emulsion Chemistry, Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g. greater than 8) treatment or through the use of reducing agents, such as stannous chloride, thiourea dioxide, polyamines and amineboranes, as illustrated by Allen et al U.S. Pat. No. 2,983,609, Oftedahl et al Research Disclosure, Vol. 136, August 1975, Item 13654, Lowe et al U.S. Pat. Nos. 2,518,698 and 2,739,060, Roberts et al U.S. Pat. Nos, 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

The silver halide emulsions employed in this invention can be sensitized by conventional techniques such as are described in Research Disclosure, Vol. 178, December 1978.

Another chemical sensitization technique is to deposit a silver salt epitaxially onto the silver haloiodide grain portions of the present invention as is described in U.S. Pat. No. 4,435,501. Conventional chemical sensitization can be undertaken prior to controlled site epitaxial deposition of silver salt on the silver halide grain. When silver chloride and/or silver thiocyanate is deposited, a large increase in sensitivity may be realized merely by selective site deposition of the silver salt. Thus, further chemical sensitization steps of a conventional type need not be undertaken to obtain photographic speed. On the other hand, an additional increment in speed can generally be obtained when further chemical sensitization is undertaken, and it is a distinct advantage that neither elevated temperature nor extended holding times are required in finishing the emulsion. The quantity of sensitizers can be reduced, if desired, where (1) epitaxial deposition itself improves sensitivity or (2) sensitization is directed to epitaxial deposition sites.

Any conventional technique for chemical sensitization following controlled site epitaxial deposition can be employed. In general, chemical sensitization should be undertaken based on the composition of the silver salt deposited rather than the composition of the host grains since chemical sensitization is believed to occur primarily at the silver salt deposition sites or perhaps immediately adjacent thereto. Conventional techniques for achieving noble metal (e.g., gold), middle chalcogen (e.g., sulfur, selenium, and/or tellurium), or reduction sensitization as well as combinations thereof are disclosed in *Research Disclosure,* Item 17643, Paragraph III, cited above.

In another form, chemical sensitization is undertaken after spectral sensitization. Similar results have also been achieved in some instances by introducing other adsorbable materials, such as finish modifiers, into the emulsion prior to chemical sensitization. Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,462,361. Other ripening agents can be used during chemical sensitization. Still a third approach, capable of being practiced independently of, but compatible with, the two approaches described above, is to deposit silver salts epitaxially as is taught in U.S. Pat. No. 4,435,501, herein incorporated by reference.

Silver halide emulsions record blue light and need not be spectrally sensitized in the blue portion of the spectrum. Silver bromide and silver bromoiodide emulsions can be employed to record blue light without incorporating blue sensitizers, although their absorption efficiency is much higher when blue sensitizers are present. The silver halide emulsions, regardless of composition, intended to record minus blue light are spectrally sensitized to red or green light by the use of spectral sensitizing dyes.

The silver halide emulsions of this invention can be spectrally sensitized with dyes from a variety of classes, including the polymethine dye class, which classes include the cyanines, merocyanines, complex cyanines and merocyanines (i.e., tri-, tetra-, and poly-nuclear cyanines and merocyanines), oxonols, hemioxonols, styryls, merostyryls, and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolinium, oxazolinium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include joined by a double bond or a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-1,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired.

Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by U.S. Pat. Nos. 3,628,960 and Locker et al U.S. Pat. No. 4,225,666. The Locker et al '666 patent specifically contemplates introduction of spectral sensitizing dye into the emulsion so that a portion of the dye is present prior to chemical sensitization and a remaining portion is introduced after chemical sensitization. Unlike Locker et al, it is specifically contemplated that the spectral sensitizing dye can be added to the emulsion during precipitation. Sensitizing can be enhanced by pAg adjustment, including variation in pAg which completes one or more cycles, during chemical and/or spectral sensitization. A specific example of pAg adjustment is provided by *Research Disclosure,* Vol. 181, May 1979, Item 18155.

Addition of addenda, such as spectral sensitizing dyes, to the grains of this invention includes adding such addenda to all sides or faces of the grains thereby providing for potential increase of the effects to be derived from such addenda.

The sensitization step, whether chemical or spectral, can be accomplished before completion of formation of hollow grains. This procedure allows both interior as well as exterior surfaces of the grain to be sensitized thereby providing a high surface area to volume ratio and enhanced light absorption.

In addition to the radiation-sensitive emulsions described above the photographic elements described herein can include a variety of features which are conventional in multicolor photographic elements and therefore require no detailed description. For example, the photographic elements can employ conventional features, such as disclosed in *Research Disclosure,* Item 17643, cited above and herein incorporated by reference. Optical brighteners can be introduced, as disclosed by Paragraph V. Antifoggants and sensitizers can be incorporated as disclosed by Paragraph VI. Absorbing and scattering materials can be employed in the emulsions of the invention and in separate layers of the photographic elements, as described in Paragraph VIII. Hardeners can be incorporated, as disclosed in Paragraph X. Coating aids, as described in Paragraph XI, and plasticizers and lubricants, as described in Paragraph XII, can be present. Antistatic layers, as described in Paragraph XIII, can be present. Methods of addition of addenda are described in Paragraph XIV. Matting agents can be incorporated, as described in Paragraph XVI. Developing agents and development modifiers can, if desired, be incorporated, as described in Paragraphs XX and XXI. Silver halide emulsion layers as well as interlayers, overcoats, and subbing layers, if any, present in the photographic elements can be coated and dried as described in Paragraph XV.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimentional, abrasive, hardness, frictional, antihalation and/or other properties of the support surface. Typical of useful paper and polymeric film supports are those disclosed in *Research Disclosure,* Item 17643, cited above, Paragraph XVII.

The photographic elements can be used to form dye images therein through the selective destruction or formation of dyes. The photographic elements can be used to form dye images by employing developers containing dye image formers, such as color couplers, as illustrated by U.K. Pat. Nos. 478,984 and 886,723; by U.S. Pat. Nos. 3,113,864, 3,002,836; 2,271,238; 2,362,598; 2,950,970; 2,592,243; 2,343,703; 2,376,380; 2,369,489; 886,723 2,899,306; 3,152,896; 2,115,394; 2,252,718; 2,108,602 and 3,547,650. In this form the developer contains a color-developing agent (e.g., a primary aromatic amine) which in its oxidized form is capable of reacting with the coupler (coupling) to form the image dye.

The dye-forming couplers can be incorporated in the photographic elements, as illustrated by Schneider et al, *Die Chemie,* Vol. 57, 1944, p. 113, and by U.S. Pat. Nos. 2,304,940; 2,269,158; 2,322,027; 2,376,679; 2,801,171; 3,748,141; 2,772,163; 2,835,579; 2,533,514; 2,353,754; 3,409,435 and also *Research Disclosure,* Vol. 159, July 1977, Item 15930. The dye-forming couplers can be incorporated in different amounts to achieve differing photographic effects. For example, U.K. Pat. No. 923,045 and U.S. Pat. No. 3,843,369 teach limiting the concentration of coupler in relation to the silver coverage to less than normally employed amounts in faster and intermediate speed emulsion layers.

It is especially contemplated that dye-forming couplers and other photographically useful compounds, such as development inhibitors and development accelerators may be incorporated in the hollow center of the grains of this invention. This can be accomplished by adding such compounds to the precipitation vessel prior to completing the formation of hollow grains and removing of unincorporated photographically useful compounds by washing, etc. These compounds would be available to be released from the center of the grains during photographic processing.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents.

The dye-forming couplers upon coupling can release photographically useful fragments, such as development inhibitors or accelerators, bleach accelerators, developing agents, silver halide solvents, toners, hardeners, fogging agents, antifoggants, competing couplers, chemical or spectral sensitizers and desensitizers. Development inhibitor-releasing (DIR) couplers are illustrated by various patents, including U.S. Pat. Nos. 3,148,062; 3,227,554; 3,733,201; 3,265,506; and 3,869,291. Dye-forming couplers and non dye-forming compounds which upon coupling release a variety of photographically useful groups are described in U.S. Pat. No. 4,248,962. DIR compounds which do not form dye upon reaction with oxidized color-developing agents can be employed, as illustrated by German OLS 2,529,350 and U.S. Pat. Nos. 3,928,041; 3,958,993 and 3,961,959. DIR compounds which oxidatively cleave can be employed as illustrated by U.S. Pat. Nos. 3,379,529; 3,043,690, 3,364,022; 3,297,445 and 3,287,129. Silver halide emulsions which are relatively light insensitive, such as Lippmann emulsions, have been utilized as interlayers and overcoat layers to prevent or control the migration of development inhibitor fragments as described in U.S. Pat. No. 3,892,572.

The photographic elements can incorporate colored dye-forming couplers, such as those employed to form integral masks for negative color images, as illustrated by U.S. Pat. Nos. 2,449,966; 2,521,908; 3,034,892; 3,476,563; 3,519,429; 2,543,691; 3,028,238; 3,061,432 and U.K. Pat. No. 1,035,959.

EXAMPLE

The preparation of hollow radiation sensitive silver halide grains is illustrated as follows wherein Steps (a) and (b) are completed together and are then followed by Steps (c) and (d), and then, if desired, further grain growth as described above.

(a) To an 8 liter vessel was added 30 g gelatin and 300 ml distilled water. The resulting solution was adjusted to a temperature of 35° C. and the pAg was adjusted to 6.5 using 0.01M $AgNO_3$; 3000 ml of a 1.0N KI solution and 3000 ml of a 1.0N $AgNO_3$ solution were prepared. Addition of these solution to the vessel were then begun using a double-jet technique with pAg control by an addition rate of 1 ml/min for 5 minutes.

After this, 20 g of gelatin was dissolved in 500 ml of distilled water and this solution was added to the vessel.

(b) Growth of the crystals was continued by utilizing an accelerated double jet flow scheme as outlined below:

| Segment time | Start flow rate | End flow rate |
|---|---|---|
| 20 min | 1.0 ml/min | 1.0 ml/min |
| +120 min | 1.0 ml/min | 5.0 ml/min |
| +120 min | 5.0 ml/min | 9.0 ml/min |

After the reactant solutions were added, the emulsion was washed and then concentrated to 1.19 Kg/mol Ag. The emulsion pAg was 8.1 at 40° C.

(c) To an 18 liter vessel was added: 100 g gelatin 8.3 g potassium iodide 4.76 g of emulsion from Step (b) above 5,000 ml distilled water The resulting solution was adjusted to a temperature of 70° C.; the pAg was 11.5.

2500 ml of a 2.0N KI solution and 8800 ml of a 0.5N $AgNO_3$ solution were prepared. These solutions were added to the vessel via a double-jet, pAg controlled fashion starting at 50 ml/min of silver reactant. A growth profile was also used here as follows:

| Segment Time | Ag Start | Ag end | salt start | salt end |
|---|---|---|---|---|
| 5 min | 50 ml/min | 50 ml/min | 12.5 ml/min | 12.5 ml/min |
| 83 min | 50 ml/min | 140 ml/min | 12.5 ml/min | 35 ml/min |

After the reactants were added the emulsion was washed and concentrated for use in Step (d).

The silver iodide emulsion grains formed from steps (a) through (c) are of the morphological configuration of four hexagonal bipyramids, the four bases of which are joined to form a common tetrahedron.

(d) To an 18 liter vessel is added: 100 gm gelatin 5.9 gm NaBr 100 ml 15M Ammonia solution 1.2 mole silver iodide emulsion from step (d) 5 liter distilled water The temperature is adjusted to 80° C.; the pAg was 8.1.

5,000 ml of a 2.0N sodium bromide solution and 5,000 ml of 2.0N silver nitrate were prepared. These solutions were added to the container via a double-jet, pAg controlled method at 10 ml/min for 20 minutes.

The growth of the emulsion is continued with the same reactant solutions via the controlled double-jet technique and the following flowrate profile:

| Segment time | Start flow rate | End flow rate |
|---|---|---|
| 20 min | 10 | 15 |
| 20 min | 15 | 25 |

Growth is continued further with the reactant flowrate profile below:

| Segment time | Start flow rate | End flow rate |
|---|---|---|
| 20 min | 25 | 40 |
| 20 min | 40 | 60 |
| 20 min | 60 | 85 |
| 5 min | 85 | 94 |

During the course of the double-jet precipitation 8.8 moles of silver bromide are precipitated, resulting in a final emulsion that is 12% iodide.

This invention has been described in detail with particular reference to preferred embodiments thereof, but it will be understood that variations and modifications can be affected within the spirit and scope of the invention.

What is claimed is:

1. A process for the preparation of hollow, radiation sensitive silver halide grains which process comprises the steps of:

(a) forming in a colloid dispersing medium silver halide grains containing at least 90 mol % iodide and having predominantly crystals of the configuration of four truncated hexagonal bipyramids, the four bases of which are joined to form a common tetrahedron by homogeneous nucleation of silver iodide grains at a pAg of from about 11.0 to about 5.0 at a temperature between about 30° and about 90° C.;

(b) maintaining the conditions in step (a) until the silver iodide grains are from about 0.005 to about 0.5 μm in diameter;

(c) altering the growth environment of the silver iodide grains to a pAg of from about 13.5 to about 9.8 at a temperature from about 30° to about 90° C.; and (d) nucleating iodohalide epitaxy on the end faces of each of the four hexagonal bipyramids of the silver iodide grains at a pAg of from about 3.0 to about 11.0 and a temperature between about 30° and 90° C.

2. The process of claim 1 wherein grain growth is continued after step (d) to the point at which the edges of the adjacent epitaxial crystals meet.

3. The process of claim 2 wherein grain growth is continued to close the corners between the major faces of the four hexagonal bipyramids.

4. The process of claim 3 which comprises precipitating additional silver halide on the external surface of the hollow grains.

5. The process of claim 1 comprising removing water soluble salts formed during steps (a), (b) or (c).

6. The process of claim 1 wherein the halide in step (d) is one or more of bromide or chloride.

7. The process of claim 1 wherein the epitaxy formed in step (d) is of a tabular habit.

8. The process of claim 1 wherein the epitaxy formed in step (d) is of an octahedral habit.

9. The process of claim 1 wherein the epitaxy formed in step (d) is of a cubic habit.

10. The process of claim 1 wherein step (d) is carried out in the presence of a silver halide solvent.

11. The process of claim 10 wherein the silver halide solvent is ammonia.

12. The process of claim 10 wherein the solvent is a thioether compound.

13. The process of claim 10 wherein the solvent is a thiocyanate compound.

14. Hollow silver halide grains comprising major surfaces of the type inherently associated with epitaxial crystals and additional minor surfaces which bridge said major surfaces.

15. The grains of claim 14 wherein the minor surfaces are incomplete.

16. The grains of claim 14 wherein the major surfaces are incomplete.

17. The grains of claim 14 which are chemically sensitized.

18. The grains of claim 14 which are spectrally sensitized.

19. The grains of claim 14 which contain a modifying agent.

20. The hollow grains of claim 14 which contain a developing agent.

21. The grains of claim 14 which contain a development accelerator.

22. The grains of claim 14 which contain a development inhibitor.

23. The grains of claim 14 which contain a dye-forming coupler compound.

24. The grains of claim 14 which have an equivalent circular diameter of from 0.1 μm to about 20 μm.

25. The grains of claim 14 which have a bulk iodide content of from about 2 to about 80 mole %.

26. The hollow grains of claim 25 in which the remainder of the halide is bromide.

* * * * *